United States Patent [19]

Gyomrey

[11] 4,363,413

[45] Dec. 14, 1982

[54] ENDLESS CHAIN DRIVE FOR TELESCOPIC JIB SECTIONS

[75] Inventor: Karl M. Gyomrey, Belmont, England

[73] Assignee: Coles Cranes Limited, Sunderland, England

[21] Appl. No.: 179,360

[22] Filed: Aug. 18, 1980

[30] Foreign Application Priority Data

Aug. 27, 1979 [GB] United Kingdom ..... 7928799

[51] Int. Cl.[3] ..... B66C 23/04; B66C 23/70; B66C 23/82

[52] U.S. Cl. ..... 212/262; 212/267

[58] Field of Search ..... 212/184, 230, 231, 264, 212/267, 268, 269, 262; 187/9 E; 52/121

[56] References Cited

U.S. PATENT DOCUMENTS

| | | | |
|---|---|---|---|
| 3,396,601 | 8/1968 | Wright | 212/267 X |
| 3,469,712 | 9/1969 | Haulotte | 212/264 |
| 3,889,818 | 6/1975 | Wennerstrom | 212/231 X |

FOREIGN PATENT DOCUMENTS

| | | | |
|---|---|---|---|
| 1580387 | 9/1969 | France | 212/267 |

*Primary Examiner*—James L. Rowland

*Attorney, Agent, or Firm*—Townsend and Townsend

[57] ABSTRACT

A crane of the telescopic jib type wherein the telescopic jib sections are driven for outward and inward telescopic movement by a chain cable or the like which is connected to the jib sections and movement of which in one direction drives the sections outwardly and movement of which in the other direction drives the sections inwardly. This enables a simple and relatively cheap drive means to be employed.

11 Claims, 3 Drawing Figures

ENDLESS CHAIN DRIVE FOR TELESCOPIC JIB SECTIONS

This invention relates to cranes and in particular to cranes of the type have a jib formed of two or more sections which can be telescoped together.

Such cranes, which will hereafter be referred to as telescopic jib cranes, are usually mobile, i.e. the jib is mounted on a vehicle, the jib being contracted when the crane is to be moved, and extended when the crane is to be used.

Hitherto, it has been the practice to provide hydraulic rams to extend and contract the various jib sections of telescopic jib cranes. However, the provision of such rams, one often being provided for each section, is expensive and the rams which are relatively heavy, increase the weight on the vehicle of a mobile crane thus restricting the load which may be carried by the crane.

A telescopic jib crane in accordance with this invention includes a chain, cable or the like which is connected to at least two telescopic sections of the jib, which passes around at least one pulley sprocket or sheave and which is provided with drive means, the arrangement being such that on operation of the drive means in one direction, the chain or the like is moved to urge the sections outwardly relative to each other and on operation of the drive means in the other direction, the sections are urged to telescope within each other. The chain or the like is preferably an endless loop.

If a chain is employed, which is preferably for safety, then the drive means may include a motor driven chain wheel. Otherwise a winch or the like may be employed.

It will be appreciated that the provision within the telescoping sections of the jib of a single chain or the like together with its associated drive means is very much simpler to operate and is very much lighter in weight than is a number of hydraulic rams.

If the telescopic jib comprises three sections, then preferably the chain is connected at or adjacent the outer end of the base section, passes around a sprocket (which may be driven by the drive means), positioned at and connected to, the inner end of the intermediate section, passes up within the intermediate section, and is anchored to the inner end of the outer or head section of the jib, the chain then passing around a further sprocket at the outer end of the intermediate section back to the anchor point at the head of the base section. Expressed alternatively, the chain loop extends between two sprockets mounted at either end of the intermediate section and is connected to both the head and base sections.

The drive means preferably includes a reversible motor or motor and gear box to enable the direction of drive to be reversed. The motor may, for example, be a high torque low speed hydraulic motor which may be provided with an external brake.

The jib section drive means of this invention is particularly useful with a crane in accordance with the invention of our co-pending application No. 179,307 filed co-terminously herewith, wherein the telescopic jib constitutes a strut supported by tie "ropes" and a tie rope and load compensation arrangement is provided within the jib sections. As explained in the specification of the said application, the load compensation arrangement acts so that as the jib sections are extended, the increasing tension in the tie "ropes" acts to urge the sections outwardly so that only a relatively small force is required to move the said sections outwardly.

An example of the telescopic jib crane in accordance with the invention will now be described by way of example, with reference to the accompanying drawings in which:-

Figure 1:
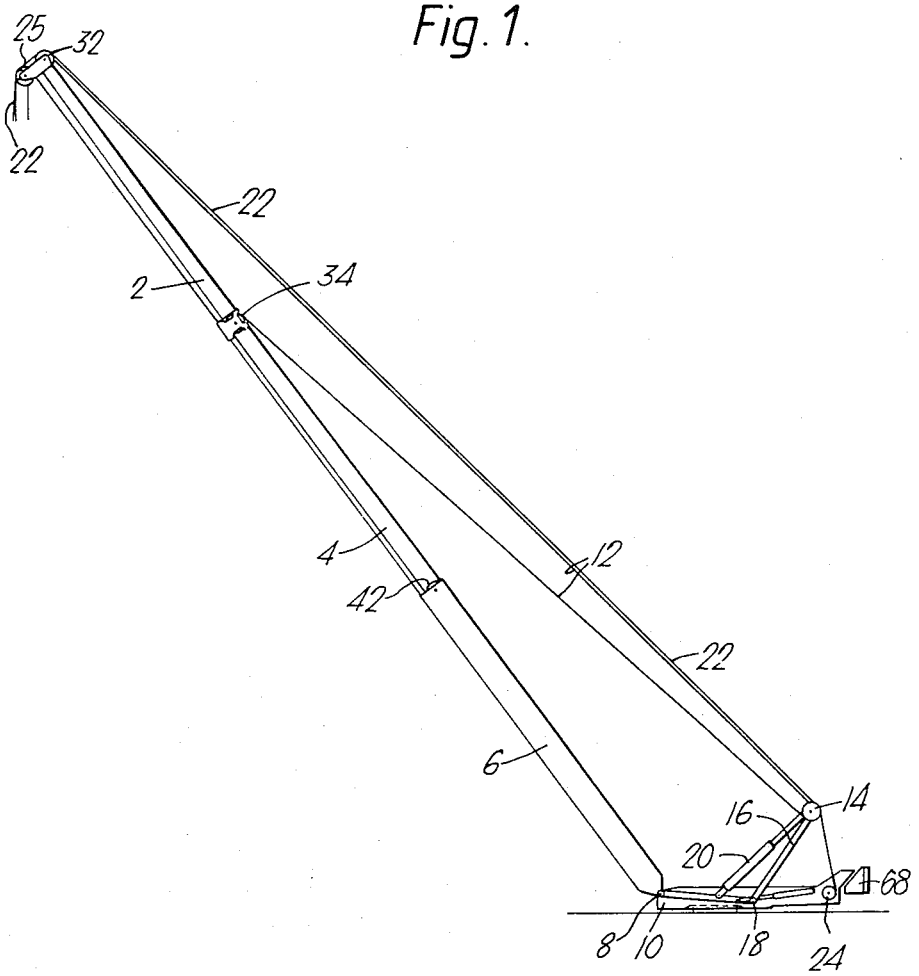
FIG. 1 is a diagrammatic view of one embodiment of a telescopic jib of a crane in accordance with the invention showing the jib in its erected position.

Referring to FIG. 1, the crane jib which is a "strut" jib is formed of three telescopic sections, namely, a head section 2, an intermediate section 4 and a base section 6. The base section 6 is pivotally mounted at 8 to a turntable platform 10 which may be rotatably mounted in a fixed position or which may form part of a mobile crane vehicle such as that illustrated in FIG. 3.

A mobile crane having a telescopic strut jib forms the subject of our co-pending application No. 179,307 filed co-terminously herewith.

The strut jib is supported by two tie ropes 12 of fixed length one at each side of the jib and only one of which is shown in the drawing. Each tie rope passes around a support pulley or sheave 14 carried at one end of a derrick mast 16, the other end of which is pivotally mounted at 18 to the turntable 10.

The angle of the mast 16 to the turntable 10 and hence the angle of the jib is determined by an adjustable ram 20 pivotally connected between the turntable and the head of the derrick mast 16.

A standard hoist rope 22 extends from a hoist 24 on the turntable, around a sheave at the head of the derrick mast, around pulleys 25 at the head of the outer section 2 of the jib for connection to a standard crane hook or the like (not shown).

Figure 2:
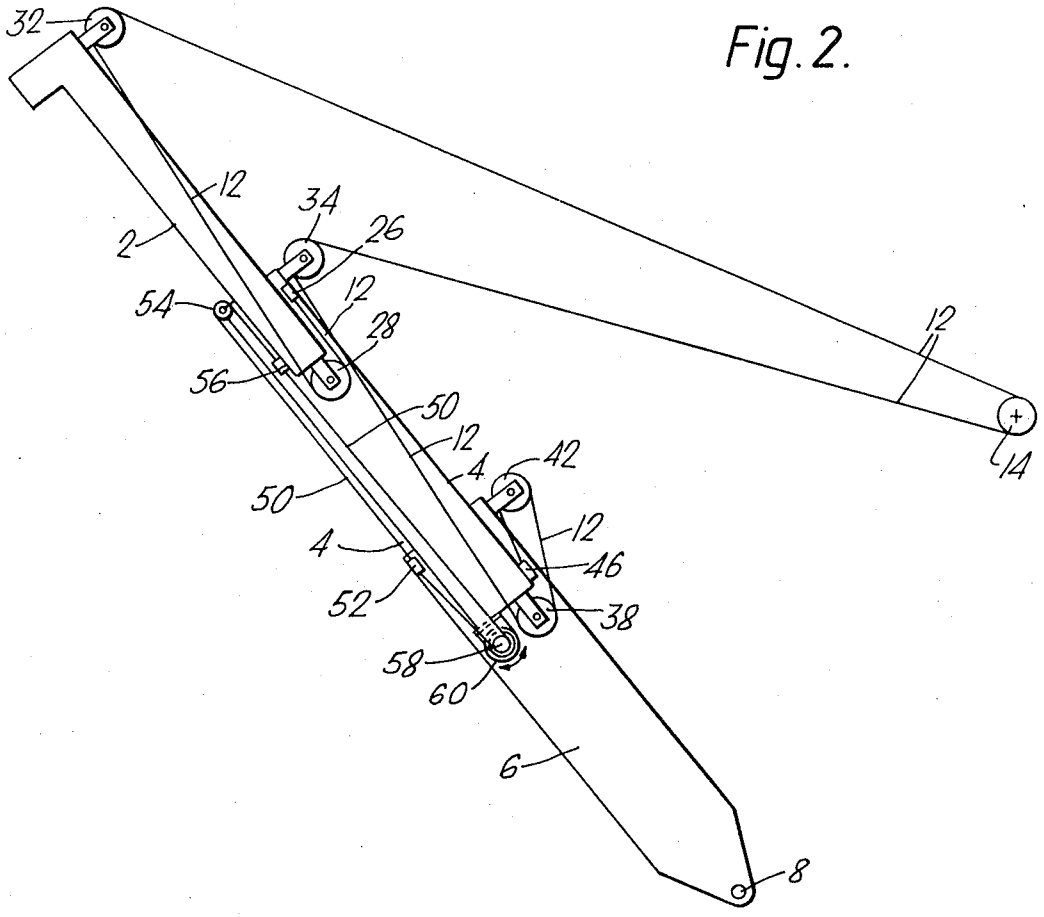
FIG. 2 is a diagram showing the arrangement of the means for extending the jib sections.

As can be seen in FIG. 2, one end of each tie rope 12 is anchored at 26 within the intermediate jib section 4 to a point adjacent the head of that section. The tie rope then extends around a pulley or sheave 28 extending down from, and carried by, the inner end of the outermost jib section 2 up within the jib section 2, and around a second pulley 32 extending out from, and carried by, the head of the head section 2 of the jib.

The tie rope then passes around the support pulley or sheave 14 carried by the head of the derrick mast 16, jib and then around a pulley 34 extending out from, and carried by, the head of the second or intermediate jib section 4. The tie rope then passes down the second jib section and out from the bottom thereof, around a pulley 38 extending from, and carried by, the inner end of the second or intermediate jib section.

The tie rope finally extends out from the base section around a further pulley 42 extending out from, and carried by, the head of the base section 6 of the jib, to an anchor point 46 at the lower end of the intermediary or second jib section 4.

When the head jib section 2 is telescoped into the intermediate section 4, the length of tie rope extending between the pulley 28 and the anchor point 26 is extended to compensate for the extent of telescopic movement of the head jib section 2 within the intermediate jib section 4. Equally, when the section 4 is telescoped into the base section 6, the length of tie rope extending between the pulleys 38 and 42 is extended to compensate for the movement of the two sections together. The length of tie rope between the pulley 42 and the anchor 46 also increases to compensate for the movement of the jib section 2 towards the base section 6. Thus the length of tie rope extending between the support pulley 14 at the derrick mast head, and the pulleys 32 and 34 is reduced to compensate for the shorter jib length whilst maintaining the angle of the jib approximately constant.

Equally, when the jib sections are extended the length of tie rope taken up within the jib length is reduced allowing the length of jib ropes between the pulleys 32, 34 and 14 to extend, again maintaining the jib angle approximately constant.

When the jib is subjected to load, the load increases the tension in the tie ropes 12 and this increase in tension, as can readily be appreciated from FIG. 2, acts to urge the jib sections to move out from each other which compensates for the tendency of the applied load to drive the jib sections back within each other.

When the jib sections are being moved outwardly from each other, it will be appreciated that the further the extension, the greater the tension in the tie rope 12, and the greater the tension, the greater the force supplied by the tie ropes on the pulleys 28 and 38 tending to move the sections outwardly. This arrangement therefore has the advantage that the means provided to move the jib sections outwardly need be less powerful than what otherwise would be the case.

The jib sections are moved inwardly and outwardly relative to each other by an endless loop of chain 50 anchored at 52 adjacent the head of the base section 6, and then passing up outside the intermediate or second jib section 4 to pass around a sprocket 54 positioned at the top of the intermediate section 4. The chain then passes down within the intermediate section and is anchored at 56 to the inner end of the outermost or head section 2.

The chain then passes around a chain wheel or sprocket 58 attached to a bracket extending from the innermost end of the intermediate or second section 4 before returning to be anchored at 52.

The chain wheel 58 is driven by a motor generally indicated at 60 which is either reversible or which is provided with a gear box enabling the direction of movement of the chain loop to be reversed.

The motor 60 may be a high torque low speed hydraulic motor. If an external brake is fitted to the motor, the sections may be telescoped when carrying a load, and held in a retracted position by the brake.

When the motor 60 is driven to rotate the chain loop in a clockwise direction as seen in FIG. 2, the head section 2 of the jib is moved within the intermediate section 4 due to the connection of the chain at 56 and the loop surrounding the chain wheel 58 is extended allowing the intermediate section 4 to move within the base section 6.

Equally, when the direction of drive is reversed so that the chain is moved in an anti-clockwise direction as seen in FIG. 2, the head section 2 is urged outwardly from the intermediate section 4 and intermediate section 4 is itself moved outwardly from the base section 6.

The outward movement of the various sections is aided by the load compensation arrangement as described above.

The invention thus provides a low cost, low weight, jib section drive system.

Figure 3:
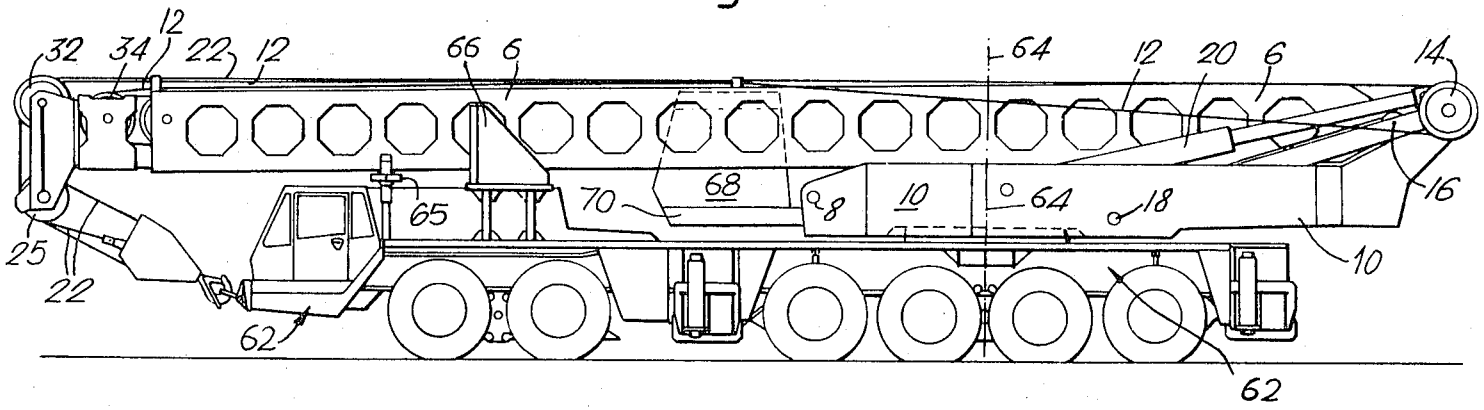
FIG. 3 is an elevation of a mobile crane with the jib sections contracted for transport.

Referring to FIG. 3, the jib sections are shown in their collapsed condition carried on a vehicle 62, with the turntable 10 mounted on the vehicle for rotation about an axis indicated by the dot and dash line 64.

The jib may be moved from the erected position shown in FIGS. 1 and 2 to the contracted position in the manner described in our co-pending application No. 179,307 (filed co-terminously herewith).

In the collapsed position, the jib sections rest on supports 65, 66 and a counterweight 68, which in use is mounted at the rear of turntable 10 (see FIG. 1) is carried on a platform 70.

I claim:

1. A telescopically extensible boom crane comprising:

a base boom section mounted to a crane platform;

an intermediate boom sectionry telescopically mounted within said base boom section, said sectionry comprising at least one intermediate boom section;

a head boom section telescopically mounted within said intermediate sectionry;

flexible boom section extension means including a closed loop extending the length of said intermediate sectionry between an inner loop guide means mounted to a base end of said intermediate sectionry and an outer loop guide means mounted to a head end of said intermediate sectionry;

means for securing said loop to said head section and to said base section at fixture points; and means mounted to said intermediate sectionry for driving said loop whereby actuation of said drive means to drive said loop extends or retracts said boom.

2. A crane as claimed in claim 1 wherein said loop comprises a chain, said inner loop guide means comprises a sprocket engageable with links of said chain, and said drive means comprises a motor mounted to said base end of said intermediate boom sectionry and drivingly connected to said sprocket.

3. A crane as claimed in claim 2 wherein said motor includes a high torque low speed motor provided with a brake whereby said boom sections may be held in an extended position by application of said brake.

4. A crane as claimed in claim 1 wherein said loop includes first and second legs, said first leg extends directly from said inner guide means to a first fixture point on said base section while said second leg extends directly from said inner guide to a second fixture point on said head section.

5. A crane as claimed in claim 1 wherein said loop includes first and second legs, the first leg extends directly from said outer guide means to a fixture point on a head end of said base section and the second leg extends directly from said outer guide means to a fixture point on a foot end of said head section.

6. A telescopically extensible boom crane comprising a base boom section pivotally mounted for luffing from a crane platform, a derrick mast mounted to said platform, tie means extending from said mast to said boom for luffing said boom, said boom further comprising intermediate boom sectionry telescopically mounted within said base boom section, said sectionry comprising at least one intermediate boom section, a head boom section telescopically mounted within said intermediate sectionry, flexible boom extension means formed as a closed loop extending the length of said intermediate sectionry between intermediate inner loop guide means mounted to the base of said intermediate sectionry, outer loop guide means mounted to the head of said intermediate sectionry, said head section and said base section being connected to said loop at points between said inner and outer loop guide means, drive means drivingly engageable with said loop at a point along a path defined by a portion of each said guide means and lines interconnecting said portions, whereby actuation of said drive means so as to drive said loop extends or retracts said boom.

7. A crane as claimed in claim 6 wherein said tie means comprises at least one tie rope extending from a fixture point at the head of said intermediate sectionry around guide means at the base of said head section, thence to guide means at the head of said head section, thence to guide means at the head of said mast, thence to guide means at the head of said intermediate sectionry, thence to guide means at the base of said intermediate sectionry, thence to guide means at the head of said base section and thence to a fixture point at the base of said intermediate sectionry, said mast being pivotally mounted to said crane platform, and means for pivoting said mast in a vertical plane whereby said boom may be luffed.

8. A crane as claimed in claim 6 wherein said extension means comprises a chain and said inner guide means comprises a sprocket engageable with links of said chain, and said drive means comprises a motor mounted to said base of said intermediate boom sectionry and drivingly connected to said sprocket.

9. A crane as claimed in claim 8 wherein said motor comprises a high torque low speed motor provided with braking means whereby said boom sections may be held in an extended position by application of said brake.

10. A method of extending the boom of a telescopically extensible boom crane, said boom comprising a base boom section mounted to a crane platform, intermediate boom sectionry telescopically mounted within said base boom section, said sectionry including at least one intermediate boom section, a head section telescopically mounted within said intermediate sectionry, the method comprising the steps of: forming a flexible boom section extension means in a closed loop extending only the length of said intermediate sectionry and guided at each end of said intermediate sectionry; fixing said loop at a first position along said loop to a foot end of said head section and at a second position along said loop to a head end of said base section; driving said loop to telescope said boom sections; and braking said loop to hold said boom at a chosen telescoped position.

11. A method as claimed in claim 10 wherein said loop is driven at the lowest guided point on said loop on the base of said intermediate sectionry.

* * * * *